US005259887A

United States Patent [19]

Takahashi et al.

[11] Patent Number: 5,259,887

[45] Date of Patent: Nov. 9, 1993

[54] HEAT-RESISTANT, FERRITIC CAST STEEL, EXHAUST EQUIPMENT MEMBER MADE THEREOF

[75] Inventors: Norio Takahashi, Omiya; Toshio Fujita, Tokyo, both of Japan

[73] Assignee: Hitachi Metals, Ltd., Japan

[21] Appl. No.: 932,574

[22] Filed: Aug. 20, 1992

[30] Foreign Application Priority Data

| | | | |
|---|---|---|---|
| Aug. 21, 1991 | [JP] | Japan | 3-234128 |
| Aug. 21, 1991 | [JP] | Japan | 3-234129 |
| Apr. 7, 1992 | [JP] | Japan | 4-114135 |
| Apr. 7, 1992 | [JP] | Japan | 4-114136 |

[51] Int. Cl.[5] ..... C22C 38/22

[52] U.S. Cl. ..... 148/325; 148/326

[58] Field of Search ..... 148/325, 326

[56] References Cited

U.S. PATENT DOCUMENTS

| | | | |
|---|---|---|---|
| 5,096,514 | 3/1992 | Watanabe et al. | 148/325 |
| 5,152,850 | 10/1992 | Takahashi et al. | 148/325 |

FOREIGN PATENT DOCUMENTS

| | | |
|---|---|---|
| 2-175841 | 7/1990 | Japan . |
| 369481 | 7/1963 | Switzerland . |
| 1205250 | 9/1970 | United Kingdom . |

OTHER PUBLICATIONS

Abridged Translation of Japanese Patent Application No. 2-175841.

*Primary Examiner*—Deborah Yee

*Attorney, Agent, or Firm*—Finnegan, Henderson, Farabow, Garrett & Dunner

[57] ABSTRACT

The heat-resistant, ferritic cast steel suitable for exhaust equipment members such as exhaust manifolds and turbine housings has a composition consisting essentially, by weight, of:

C: 0.15–0.45%,
Si: 2.0% or less,
Mn: 1.0% or less,
Cr: 17.0–22.0%,
W: 1.0–3.0%,
Nb and/or V: 0.01–0.45%,
rare earth metal: 0.01–0.5%, and Fe and inevitable impurities: balance, the cast steel having, in addition to a usual $\alpha$-phase, an $\alpha'$-phase consisting of the $\alpha$-phase and carbides and transformed from a $\gamma$-phase, and an area ratio $(\alpha'/(\alpha+\alpha'))$ being 20–80%.

18 Claims, 3 Drawing Sheets

HEAT-RESISTANT, FERRITIC CAST STEEL, EXHAUST EQUIPMENT MEMBER MADE THEREOF

BACKGROUND OF THE INVENTION

The present invention relates to a heat-resistant cast steel suitable for exhaust equipment members, etc. for automobile engines, and more particularly to a heat-resistant cast steel having excellent thermal fatigue resistance, oxidation resistance, durability, castability and machinability, which can be produced at a low cost, and an exhaust equipment member made of such a heat-resistant cast steel.

Conventional heat-resistant cast iron and heat-resistant cast steel have compositions shown in Table 1 as Comparative Examples. In exhaust equipment members such as exhaust manifolds, turbine housings, etc. for automobiles, heat-resistant cast iron such as high-Si spheroidal graphite cast iron, NI-RESIST cast iron (Ni-Cr-Cu austenitic cast iron), etc. shown in Table 1, and exceptionally expensive heat-resistant, high-alloy cast steel such as austenitic cast steel, etc. are employed because their operating conditions are extremely severe at high temperatures.

Among these conventional heat-resistant cast iron and heat-resistant cast steel, for instance, high-Si spheroidal graphite cast iron and NI-RESIST cast iron are relatively good in castability, but they are poor in durability such as a thermal fatigue resistance and an oxidation resistance. Accordingly, they cannot be used for members which may be subjected to such a high temperature as 900° C. or higher. Also, heat-resistant, high-alloy cast steel such as heat-resistant austenitic cast steel, etc. is excellent in a high-temperature strength at 900° C. or higher, but it is poor in a thermal fatigue life due to a large thermal expansion coefficient. Further, because of poor castability, it is likely to suffer from casting defects such as shrinkage cavities and poor fluidity in the process of casting. In addition, because of poor machinability, the production of parts from these materials is not efficient. Incidentally, besides the above cast iron and cast steel, there is ferritic cast stainless steel. However, usual ferritic cast stainless steel would show poor ductility at a room temperature when treated such that its high-temperature strength is improved. Accordingly, it cannot be used for members which are subjected to mechanical impact, etc.

OBJECT AND SUMMARY OF THE INVENTION

Accordingly, an object of the present invention is to provide a heat-resistant, ferritic cast steel having excellent durability such as a thermal fatigue resistance and an oxidation resistance, strength and ductility at room temperature, castability, machinability, etc., which can be produced at a low cost, thereby solving the above problems inherent in the conventional heat-resistant cast iron and heat-resistant cast steel.

Another object of the present invention is to provide an exhaust equipment member made of such heat-resistant cast steel.

As a result of intense research in view of the above objects, the inventors have found that by adding proper amounts of W, Nb and/or V, REM, and if necessary Ni, etc. to the ferritic cast steel, the ferrite matrix and the crystal grain boundaries can be strengthened and the transformation temperature can be elevated without deteriorating the ductility at a room temperature, whereby the high-temperature strength of the cast steel can be improved. The present invention has been completed based upon this finding.

The heat-resistant, ferritic cast steel according to a first embodiment of the present invention has a composition consisting essentially, by weight, of:

C: 0.15–0.45%,
Si: 2.0% or less,
Mn: 1.0% or less,
Cr: 17.0–22.0%,
W: 1.0–3.0%,
Nb and/or V: 0.01–0.45%,
REM: 0.01–0.5%, and Fe and inevitable impurities: balance, wherein REM represents at least one rare earth metal, said cast steel having, in addition to a usual $\alpha$-phase, a pearlitic phase (hereinafter referred to as "$\alpha'$-phase") transformed from a $\gamma$-phase and composed of an $\alpha$-phase and carbides, and an area ratio $(\alpha'/(\alpha+\alpha'))$ being 20–80%.

In the heat-resistant, ferritic cast steel according to the first embodiment, the transformation temperature from the $\alpha'$-phase to the $\gamma$-phase is 1000° C. or higher. Further, if the removal of residual stress and working are necessary, the cast steel may be subjected to an annealing treatment at a temperature at which the $\alpha'$-phase is not transformed to the $\gamma$-phase.

The heat-resistant, ferritic cast steel according to a second embodiment of the present invention has a composition consisting essentially, by weight, of:

C: 0.05–0.30%,
Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%, and Fe and inevitable impurities: balance, wherein REM represents at least one rare earth metal, said cast steel having, in addition to a usual $\alpha$-phase, a pearlitic $\alpha'$-phase transformed from a $\gamma$-phase and composed of an $\alpha$-phase and carbides, and an area ratio $(\alpha'/(\alpha+\alpha'))$ being 20–90%.

In the heat-resistant, ferritic cast steel according to the second embodiment, the transformation temperature from the $\alpha'$-phase to the $\gamma$-phase is 900° C. or higher.

The heat-resistant, ferritic cast steel according to a third embodiment of the present invention has a composition consisting essentially, by weight, of:

C: 0.05–0.30%,
Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%,
V: 0.01–0.3%, and Fe and inevitable impurities: balance, wherein REM represents at least one rare earth metal, said cast steel having, in addition to a usual $\alpha$-phase, a pearlitic $\alpha'$-phase transformed from a $\gamma$-phase and composed of an $\alpha$-phase and carbides and an area ratio $(\alpha'/(\alpha+\alpha'))$ being 20–70%.

In the heat-resistant, ferritic cast steel according to the third embodiment, the transformation temperature from the α'-phase to the γ-phase is 950° C. or higher.

In the heat-resistant, ferritic cast steel according to the second and third embodiments, if the removal of residual stress and working are necessary, the cast steel may be subjected to an annealing treatment at a temperature at which the α'-phase is not transformed to the γ-phase.

The exhaust equipment members of the present invention are exhaust manifolds and turbine housings made of the above heat-resistant, ferritic cast steel.

DETAILED DESCRIPTION OF THE INVENTION

Figure 1:
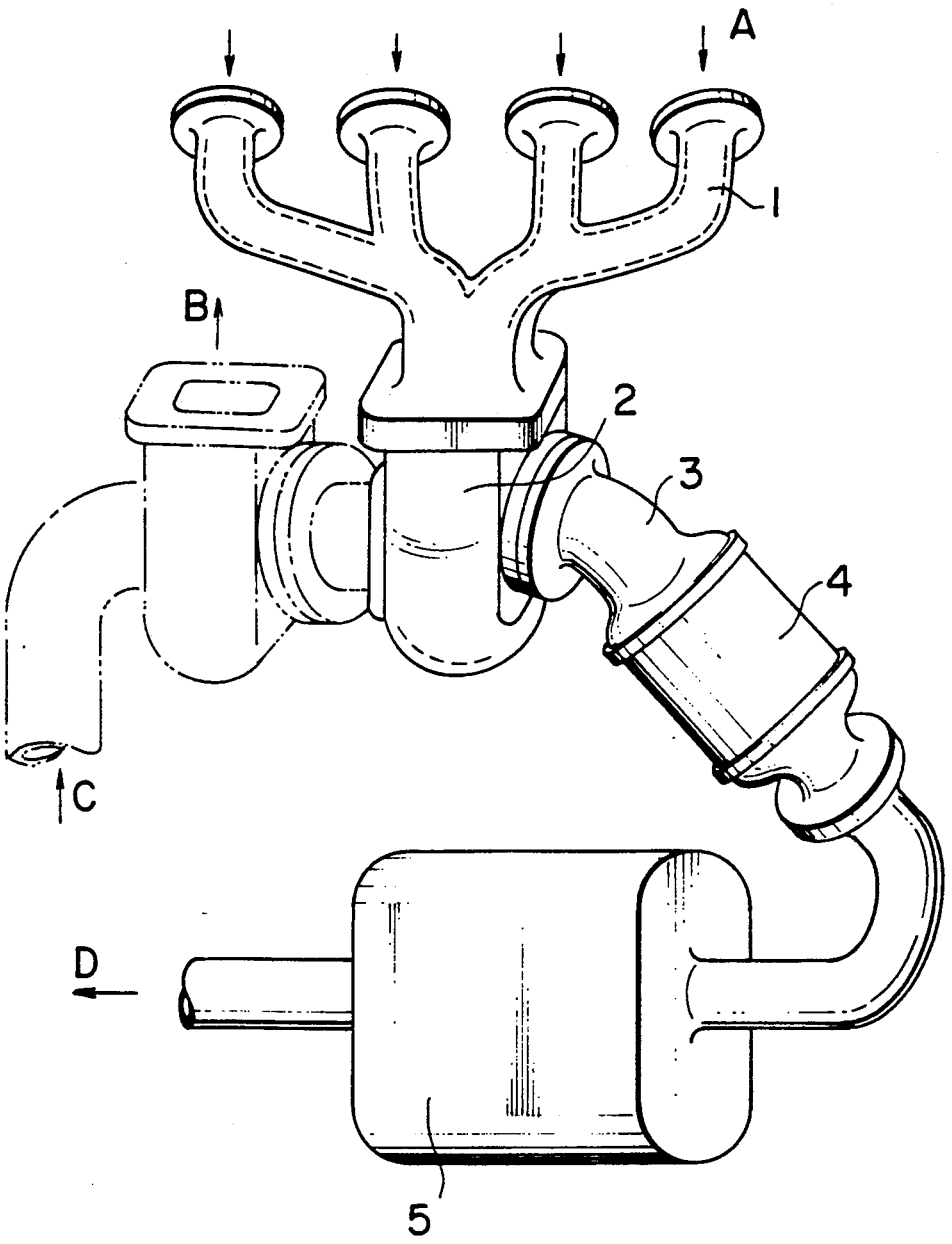
FIG. 1 is a schematic view showing exhaust equipment members (an exhaust manifold and a turbine housing) produced by the heat-resistant, ferritic cast steel of the present invention.

The present invention will be explained in detail below.

By adding to the heat-resistant, ferritic cast steel proper amounts of W, Nb and/or V and REM, and if necessary Ni, the resulting metal structure contains an α'-phase, whereby the heat-resistant, ferritic cast steel shows higher thermal fatigue resistance and oxidation resistance than those of the conventional heat-resistant, high-alloy cast steel, and castability and machinability equivalent to those of the heat-resistant cast iron, without deteriorating its ductility at a room temperature. Further, since the transformation temperature of the heat-resistant, ferritic cast steel is elevated to 900° C. or higher, its thermal fatigue resistance is greatly improved.

The reasons for restricting the composition range of each alloy element in the heat-resistant, ferritic cast steel of the present invention will be explained below.

[1] Cast Steel of First Embodiment

In the heat-resistant, ferritic cast steel according to the first embodiment of the present invention, C, Si, Mn, Cr, W, Nb and/or V, and REM are indispensable elements.

(1) C (carbon): 0.15–0.45%

C has a function of improving the fluidity and castability of a melt and forming a proper amount of an α'-phase. It further has a function of providing the heat-resistant, ferritic cast steel with a high strength at a high temperature of 900° C. or higher. To exhibit such functions effectively, the amount of C should be 0.15% or more. Incidentally, in a general heat-resistant, ferritic cast steel, there is only an α-phase at a room temperature, but by adjusting the amount of carbon, a γ-phase in which C is dissolved is formed at a high temperature, in addition to the α-phase existing from a high temperature to a room temperature. This γ-phase is transformed to (α-phase + carbides) by precipitating carbides during the cooling process. The resulting phase (α-phase + carbides) is called "α'-phase."

On the other hand, when the amount of C exceeds 0.45%, the α'-phase is less likely to exist, thereby forming a martensite structure. Also, Cr carbides which decrease the oxidation resistance, corrosion resistance and machinability of the heat-resistant, ferritic cast steel are remarkably precipitated. Accordingly, the amount of C is 0.15–0.45%. The preferred amount of C is 0.20–0.40%.

(2) Si (silicon): 2.0% or less

Si has effects of narrowing the range of the γ-phase in the Fe-Cr alloy of the present invention, thereby increasing the stability of its metal structure and its oxidation resistance. Further, it has a function as a deoxidizer and also is effective for improving castability and reducing pin holes in the resulting cast products. However, when it is excessive, primary carbides grow coarser by a balance with C (carbon equivalent), thereby deteriorating the machinability of the cast steel, and the amount of Si in the ferrite matrix becomes excessive, causing the decrease of the ductility and the formation of a δ-phase at a high temperature. Accordingly, the amount of Si should be 2.0% or less. The preferred amount of Si is 0.5–1.5%.

(3) Mn (manganese): 1.0% or less

Mn is effective like Si as a deoxidizer for the melt, and has a function of improving the fluidity during the casting operation. If the amount of Mn is too large, the resulting alloy shows poor toughness. Thus, the amount of Mn is 1.0% or less. The preferred amount of Mn is 0.4–0.7%.

(4) Cr (chromium): 17.0–22.0%

Cr is an element capable of improving the oxidation resistance and stabilizing the ferrite structure of the heat-resistant, ferritic cast steel. To insure such effects, the amount of Cr should be 17.0% or more. On the other hand, if it is added excessively, coarse primary carbides of Cr are formed, and the formation of the δ-phase is accelerated at a high temperature, resulting in extreme brittleness. Accordingly, the upper limit of Cr should be 22.0%. The preferred amount of Cr is 18.0–21.0%.

(5) W (tungsten): 1.0–3.0%

W has a function of improving the high-temperature strength by strengthening the ferrite matrix without deteriorating the ductility at a room temperature. Accordingly, for the purpose of improving a creep resistance and a thermal fatigue resistance due to the elevation of the transformation temperature, the amount of W should be 1.0% or more. However, when the amount of W exceeds 3.0%, coarse eutectic carbides are formed, resulting in the deterioration of the ductility and machinability. Thus, the upper limit of W is 3.0%. The preferred amount of W is 1.2–2.5%.

Incidentally, substantially the same effects can be obtained by the addition of Mo (since W has an atomic weight twice as much as that of Mo, the amount of Mo is ½ that of W by weight). However, since W has a higher melting point, a smaller diffusion speed at a high temperature, more contribution to a high-temperature strength (particularly at 900° C.), and a better oxidation resistance than Mo, only W is used in the present invention without using Mo.

(6) Nb (niobium) and/or V (vanadium): 0.01–0.45%

Nb and V form fine carbides when combined with C, increasing the tensile strength at a high temperature and the thermal fatigue resistance. Also, by suppressing the formation of the Cr carbides, they function to improve the oxidation resistance and machinability of the heat-resistant, ferritic cast steel. For such purposes, the amount of Nb and/or V should be 0.01% or more. However, if they are excessively added, carbides are formed in the crystal grain boundaries, and too much C is consumed by forming the carbides of Nb and V, making it less likely to form the $\alpha'$-phase. This leads to extreme decrease in strength and ductility. Accordingly, Nb and/or V should be 0.45% or less. The preferred amount of Nb and/or V is 0.02–0.40%.

Incidentally, since carbide-forming temperature ranges are different between Nb and V, precipitation hardening can be expected in a wide temperature range. Accordingly, one or both of Nb and V can be added to obtain large effects.

(7) REM (rare earth element): 0.01–0.5%

REM is a light rare earth element such as Ce (cerium), La (lanthanum), etc., which is capable of forming stable oxides, thereby improving the oxidation resistance. To exhibit such functions effectively, the amount of REM is 0.01% or more. On the other hand, when it is added excessively, it forms non-metallic inclusions which is detrimental to the ductility. Accordingly, the upper limit of REM is 0.5%. Incidentally, the addition of REM does not affect the amount of the $\alpha'$-phase and the transformation temperature. The preferred amount of REM is 0.05–0.3%.

[2] Cast Steel of Second and Third Embodiments

The amounts of C, Cr, Nb and V in the second and third embodiments are different from those in the first embodiment. In these embodiments, the above elements have the same functions as described in the first embodiment. Also, Ni is added in combination with the above elements.

(1) C (carbon): 0.05–0.30%

The amount of C is 0.05–0.30%, and preferably 0.10–0.25%.

(2) Si (silicon): 2.0% or less

The amount of Si is 2.0% or less, and preferably 0.5–1.5%.

(3) Mn (manganese): 1.0% or less

The amount of Mn is 1.0% or less, and preferably 0.4–0.7%.

(4) Cr (chromium): 16.0–25.0%

The amount of Cr is 16.0–25.0%, and preferably 17.0–22.0%.

(5) W (tungsten): 1.0–3.0%

The amount of W is 1.0–3.0%, and preferably 1.2–2.5%. In the second and third embodiments, only W is used without using Mo.

(6) Nb (niobium): 0.01–0.45%

The amount of Nb is 0.01–0.45%, and preferably 0.02–0.30%.

(7) Ni (nickel): 0.1–2.0%

Ni is a $\gamma$-phase-forming element like C, and to form a proper amount of $\alpha'$-phase, 0.1% or more of Ni is desirably added. When it exceeds 2.0%, the proportion of the $\alpha$-phase having an excellent oxidation resistance decreases, and the $\alpha'$-phase becomes a martensite phase, leading to the remarkable deterioration of ductility. Accordingly, the amount of Ni should be 2.0% or less. The preferred amount of Ni is 0.3–1.5%.

(8) REM (rare earth element): 0.01–0.5%

The amount of REM is 0.01–0.5%, and preferably 0.05–0.3%.

The cast steel of the third embodiment contains V in addition to the above elements (1)–(8).

(9) V (vanadium): 0.01–0.3%

V has the same function as Nb. Since V corresponds to two times of Nb in atomic %, it is preferable that the amount of Nb+V does not exceed 0.5%. In the case of V alone, the preferred amount of V is 0.05–0.2%.

In sum, the heat-resistant, ferritic cast steel in each embodiment has the following composition:

(1) First embodiment:
C: 0.15–0.45%,
Si: 2.0% or less,
Mn: 1.0% or less,
Cr: 17.0–22.0%,
W: 1.0–3.0%,
Nb and/or V: 0.01–0.45%,
REM: 0.01–0.5%, and
Fe and inevitable impurities: balance.

Preferred composition range:
C: 0.20–0.40%,
Si: 0.5–1.5%,
Mn: 0.4–0.7%,
Cr: 18.0–21.0%,
W: 1.2–2.5%,
Nb and/or V: 0.02–0.4%,
REM: 0.05–0.3%, and
Fe and inevitable impurities: balance.

(2) Second embodiment:
C: 0.05–0.30%,
Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%, and
Fe and inevitable impurities: balance.

Preferred composition range:
C: 0.10–0.25%,
Si: 0.5–1.5%,
Mn: 0.4–0.7%,
Cr: 17.0–22.0%,
W: 1.2–2.5%,
Nb: 0.02–0.3%,
Ni: 0.3–1.5%,
REM: 0.05–0.3%, and
Fe and inevitable impurities: balance.

(3) Third embodiment:
C: 0.05–0.30%,

Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%,
V: 0.01–0.3%, and
Fe and inevitable impurities: balance.

Preferred composition range:
C: 0.10–0.25%,
Si: 0.5–1.5%,
Mn: 0.4–0.7%,
Cr: 17.0–22.0%,
W: 1.2–2.5%,
Nb: 0.02–0.3%,
Ni: 0.3–1.5%,
REM: 0.05–0.3%,
V: 0.05–0.2%, and
Fe and inevitable impurities: balance.

Figure 2:
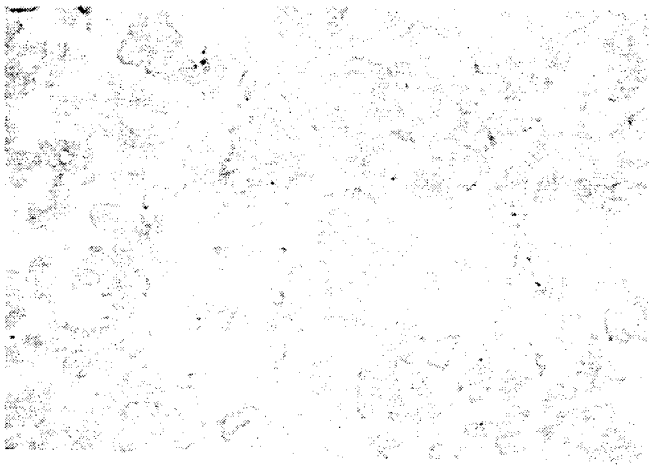
FIG. 2 is a photomicrograph (×100) showing the metal structure of the heat-resistant, ferritic cast steel of Example 7.

The heat-resistant, ferritic cast steel of the present invention having the above composition has the a pearlitic $\alpha'$-phase consisting of an $\alpha$-phase and carbides and transformed from a $\gamma$-phase, in addition to the usual $\alpha$-phase. The $\alpha'$-phase is shown in FIG. 2 as gray grains encircled by black peripheries. Incidentally, the "usual $\alpha$-phase" means a $\delta$ (delta) ferrite phase. The precipitated carbides are carbides ($M_{23}C_6$, $M_7C_3$, MC, etc.) of Fe, Cr, W, Nb, etc.

When an area ratio $(\alpha'/(\alpha+\alpha'))$ of this $\alpha'$-phase is lower than 20%, the heat-resistant, ferritic cast steel shows poor ductility at a room temperature, so that the cast steel is extremely brittle. On the other hand, when the area ratio $(\alpha'/(\alpha+\alpha'))$ is too large (exceeding 80% in first embodiment, 90% in second embodiment, and 70% in third embodiment), the cast steel becomes too hard, resulting in poor ductility at a room temperature and extremely poor machinability. Accordingly, the area ratio $(\alpha'/(\alpha+\alpha'))$ is 20–80% in the cast steel of the first embodiment, 20–90% in the cast steel of the second embodiment, and 20–70% in the cast steel of the third embodiment.

When the removal of residual stress and working are necessary, the heat-resistant, ferritic cast steel may be subjected to an annealing treatment at a temperature at which the $\alpha'$-phase is not transformed to the $\gamma$-phase. The annealing treatment temperature is generally 700°–850° C., and the annealing time is 1–10 hours.

When there is a transformation temperature from the $\alpha'$-phase to the $\gamma$-phase in the temperature range in which the heat-resistant, ferritic cast steel is used, a large thermal stress is generated by a heating-cooling cycle, resulting in a short thermal fatigue life. Accordingly, the heat-resistant, ferritic cast steel should have a transformation temperature of 900° C. or higher. To have such a high transformation temperature, it is necessary that the ferrite-forming elements such as Cr, Si, W, V, Nb and the austenite-forming elements such as C, Ni, Mn are well balanced.

In the heat-resistant, ferritic cast steel of each embodiment, the area ratio $(\alpha'/(\alpha+\alpha'))$ and the transformation temperature are as follows:

(1) First embodiment:
Area ratio $(\alpha'/(\alpha+\alpha'))$: 20–80%.
Transformation temperature: 1000° C. or higher.

(2) Second embodiment:
Area ratio $(\alpha'/(\alpha+\alpha'))$: 20–90%.
Transformation temperature: 900° C. or higher.

(3) Third embodiment:
Area ratio $(\alpha'/(\alpha+\alpha'))$: 20–70%.
Transformation temperature: 950° C. or higher.

Such heat-resistant, ferritic cast steel of the present invention is particularly suitable for exhaust equipment members for automobiles. As the exhaust equipment members for automobiles, FIG. 1 shows an integral exhaust manifold mounted to a straight-type, four-cylinder engine equipped with a turbo charger. The exhaust manifold 1 is mounted to a turbine housing 2 of the turbo charger, which is connected to a catalyst converter chamber 4 for cleaning an exhaust gas via an exhaust outlet pipe 3. The converter chamber 4 is further connected to a main catalyzer 5. An outlet of the main catalyzer 5 is communicated with a muffler (not shown) in D. The turbine housing 2 is communicated with an intake manifold (not shown) in B, and an air is introduced thereinto as shown by C. Incidentally, the exhaust gas is introduced into the exhaust manifold 1 as shown by A.

Such exhaust manifold 1 and turbine housing 2 are desirably as thin as possible to have a small heat capacity. The thicknesses of the exhaust manifold 1 and the turbine housing 2 are, for instance, 2.5–3.4 mm and 2.7–4.1 mm, respectively. Such thin exhaust manifold 1 and turbine housing 2 made of the heat-resistant, ferritic cast steel show excellent durability without suffering from cracks under heating-cooling cycles.

The present invention will be explained in detail by way of the following Examples.

EXAMPLES 1–10

Comparative Examples 1–5

With respect to each heat-resistant, ferritic cast steel having a composition shown in Table 1, Y-block test pieces (No. B according to JIS) were prepared by casting. Incidentally, the casting was conducted by melting the steel in the atmosphere in a 100-kg high-frequency furnace, removing the resulting melt from the furnace at a temperature of 1550° C. or higher and immediately pouring it into a mold at about 1550° C.

TABLE 1

| | Additive Component (Weight %) | | | | | | | | | $\alpha'/(\alpha+\alpha')$ | Transformation |
|---|---|---|---|---|---|---|---|---|---|---|---|
| | C | Si | Mn | Cr | W | Nb | V | REM | Ni | (%) | Temp. (°C.) |
| Example No. | | | | | | | | | | | |
| 1 | 0.15 | 0.82 | 0.44 | 18.6 | 1.52 | 0.05 | — | 0.03 | — | 55 | 1010 |
| 2 | 0.21 | 1.44 | 0.51 | 20.8 | 2.32 | — | 0.22 | 0.15 | — | 68 | 1040 |
| 3 | 0.31 | 1.02 | 0.66 | 21.6 | 2.52 | 0.4 | 0.03 | 0.08 | — | 58 | 1070 |
| 4 | 0.41 | 1.14 | 0.58 | 18.3 | 2.85 | 0.11 | 0.16 | 0.17 | — | 72 | 1010 |
| 5 | 0.33 | 1.82 | 0.95 | 21.8 | 2.04 | 0.25 | 0.03 | 0.15 | — | 48 | >1100 |
| 6 | 0.20 | 1.05 | 0.42 | 18.5 | 1.06 | 0.10 | 0.05 | 0.1 | — | 78 | 1040 |
| 7 | 0.30 | 0.88 | 0.63 | 20.6 | 2.45 | 0.38 | 0.13 | 0.04 | — | 60 | >1100 |
| 8 | 0.41 | 0.80 | 0.49 | 21.5 | 2.25 | 0.05 | 0.20 | 0.08 | — | 68 | 1020 |
| 9 | 0.30 | 0.95 | 0.58 | 20.5 | 2.09 | 0.05 | 0.05 | 0.09 | — | 70 | >1100 |
| 10 | 0.14 | 0.89 | 0.43 | 20.7 | 2.49 | 0.25 | 0.21 | 0.42 | — | 38 | >1100 |

TABLE 1-continued

| | Additive Component (Weight %) | | | | | | | | | $\alpha'/(\alpha + \alpha')$ | Transformation |
|---|---|---|---|---|---|---|---|---|---|---|---|
| | C | Si | Mn | Cr | W | Nb | V | REM | Ni | (%) | Temp. (°C.) |
| Comparative Example No. | | | | | | | | | | | |
| 1 | 3.33 | 4.04 | 0.35 | — | — | — | — | — | 0.62* | — | 800–850 |
| 2 | 2.01 | 4.82 | 0.45 | 1.91 | — | — | — | — | 35.3 | — | — |
| 3 | 0.28 | 1.05 | 0.44 | 17.9 | — | — | — | — | — | 93 | 910 |
| 4 | 0.21 | 1.24 | 0.50 | 18.8 | — | — | — | — | 9.1 | — | — |
| 5 | 0.12 | 1.05 | 0.48 | 18.1 | — | 1.12 | — | — | — | 0 | >1100 |

Note
*Mo

With respect to the heat-resistant, ferritic cast steels of Examples 1–10, their fluidity was good in the process of casting, resulting in no casting defects. Next, test pieces (Y-blocks) of Examples 1–10 were subjected to a heat treatment comprising heating them at 800° C. for 2 hours in a furnace and cooling them in the air. On the other hand, the test pieces of Comparative Examples 1–5 were used in an as-cast state for the tests.

Incidentally, the test pieces of Comparative Examples 1–5 are those used for heat-resistant parts such as turbo charger housings, exhaust manifolds, etc. for automobiles. The test piece of Comparative Example 1 is high-Si spheroidal graphite cast iron, the test piece of Comparative Example 2 is NI-RESIST cast iron, the test piece of Comparative Example 3 is a CB-30 according to the ACI (Alloy Casting Institute) standards, the test piece of Comparative Example 4 is one of heat-resistant austenitic cast steels (SCH 12, according to JIS), and the test piece of Comparative Example 5 is a heat-resistant, ferritic cast steel described in Japanese Patent Laid-Open No. 2-175841.

As shown in Table 1, the test pieces of Examples 1–10 show transformation temperatures of 1000° C. or higher, higher than those of Comparative Examples 1 and 3.

Next, with respect to each cast test piece, the following evaluation tests were conducted.

(1) Tensile test at a room temperature

Conducted on a rod test piece having a gauge distance of 50 mm and a gauge diameter of 14 mm (No. 4 test piece according to JIS).

(2) Tensile test at a high temperature

Conducted on a flanged test piece having a gauge distance of 50 mm and a gauge diameter of 10 mm at a temperature of 900° C.

(3) Thermal fatigue test

Using a rod test piece having a gauge distance of 20 mm and a gauge diameter of 10 mm, a heating-cooling cycle was repeated to cause thermal fatigue failure in a state where expansion and shrinkage due to heating and cooling were completely restrained mechanically, under the following conditions:

Lowest temperature: 150° C.
Highest temperature: 900° C. and 1000° C.
Each 1 cycle: 12 minutes.
Incidentally, an electric-hydraulic servo-type thermal fatigue test machine was used for the test.

(4) Oxidation test

A rod test piece having a diameter of 10 mm and a length of 20 mm was kept in the air at 900° C. for 200 hours, and its oxide scale was removed by a shot blasting treatment to measure a weight variation per a unit surface area. By calculating oxidation weight loss (mg/cm$^2$) after the oxidation test, the oxidation resistance was evaluated.

The results of the tensile test at a room temperature are shown in Table 2, and the results of the tensile test, the thermal fatigue test and the oxidation test at temperatures of 900° C. and 1000° C. are shown in Tables 3 and 4.

TABLE 2

| | at Room Temperature | | | |
|---|---|---|---|---|
| | 0.2% Offset Yield Strength (MPa) | Tensile Strength (MPa) | Elongation (%) | Hardness ($H_B$) |
| Example No. | | | | |
| 1 | 365 | 465 | 6 | 170 |
| 2 | 355 | 475 | 11 | 192 |
| 3 | 375 | 515 | 7 | 201 |
| 4 | 435 | 570 | 8 | 212 |
| 5 | 355 | 495 | 6 | 212 |
| 6 | 340 | 460 | 6 | 207 |
| 7 | 350 | 440 | 11 | 197 |
| 8 | 415 | 490 | 9 | 197 |
| 9 | 400 | 505 | 5 | 217 |
| 10 | 400 | 500 | 7 | 193 |
| Comparative Example No. | | | | |
| 1 | 510 | 640 | 11 | 215 |
| 2 | 245 | 510 | 19 | 139 |
| 3 | 540 | 760 | 4 | 240 |
| 4 | 250 | 560 | 20 | 170 |
| 5 | 300 | 370 | 1 | 149 |

TABLE 3

| | at 900° C. | | | | |
|---|---|---|---|---|---|
| | 0.2% Offset Yield Strength (MPa) | Tensile Strength (MPa) | Elongation (%) | Thermal Fatigue Life (Cycle) | Weight Loss by Oxidation (mg/cm$^2$) |
| Example No. | | | | | |
| 1 | 22 | 36 | 55 | 185 | 2 |
| 2 | 24 | 42 | 50 | 200 | 2 |
| 3 | 26 | 41 | 42 | 230 | 1 |
| 4 | 28 | 45 | 48 | 350 | 2 |
| 5 | 25 | 38 | 55 | 340 | 1 |
| 6 | 29 | 44 | 50 | 450 | 2 |
| 7 | 22 | 40 | 70 | 390 | 2 |
| 8 | 30 | 45 | 38 | 490 | 1 |
| 9 | 26 | 44 | 50 | 330 | 1 |
| 10 | 21 | 40 | 58 | 295 | 2 |
| Comparative Example No. | | | | | |
| 1 | 20 | 40 | 33 | 9 | 200 |
| 2 | 40 | 90 | 44 | 23 | 20 |
| 3 | 25 | 42 | 58 | 18 | 1 |
| 4 | 65 | 128 | 31 | 35 | 2 |
| 5 | 15 | 28 | 93 | 185 | 2 |

TABLE 4

| Example No. | 0.2% Offset Yield Strength (MPa) | at 1000° C. Tensile Strength (MPa) | Elongation (%) | Thermal Fatigue Life (Cycle) | Weight Loss by Oxidation (mg/cm$^2$) |
|---|---|---|---|---|---|
| 1 | 15 | 25 | 84 | 90 | 29 |
| 2 | 16 | 25 | 88 | 180 | 10 |
| 3 | 18 | 28 | 96 | 200 | 13 |
| 4 | 17 | 28 | 96 | 300 | 11 |
| 5 | 14 | 25 | 120 | 235 | 22 |
| 6 | 19 | 30 | 115 | 340 | 33 |
| 7 | 16 | 24 | 84 | 250 | 13 |
| 8 | 19 | 30 | 92 | 355 | 18 |
| 9 | 16 | 24 | 76 | 260 | 15 |
| 10 | 14 | 26 | 84 | 210 | 9 |

As is clear from Tables 2 to 4, the test pieces of Examples 1-10 are extremely superior to those of Comparative Examples 1-5 with respect to a high-temperature strength, an oxidation resistance and a thermal fatigue life. This is due to the fact that by containing proper amounts of W, Nb and/or V and REM, the ferrite matrix was strengthened, and the transformation temperature was elevated to 1000° C. or higher without deteriorating the ductility at a room temperature. The comparison of 0.2% offset strength, tensile elongation, thermal fatigue life and oxidation loss shows that although some of Comparative Examples are better than those of Examples in one of these properties, the cast alloys of the present invention are much better than those of Comparative Examples in the total evaluation of these properties.

Also, as shown in Table 2, the test pieces of Examples 1-10 show relatively low hardness ($H_B$) of 170-217. This means that they are excellent in machinability.

Incidentally, with respect to the heat-resistant cast steel of Example 7, its photomicrograph (×100) is shown in FIG. 2. White portions in FIG. 2 are usual α-phases called δ-ferrite, and gray portions encircled by black peripheries are α'-phases transformed from the γ-phases. The area ratio of $\alpha'/(\alpha+\alpha')$ is 60%.

Figure 3:
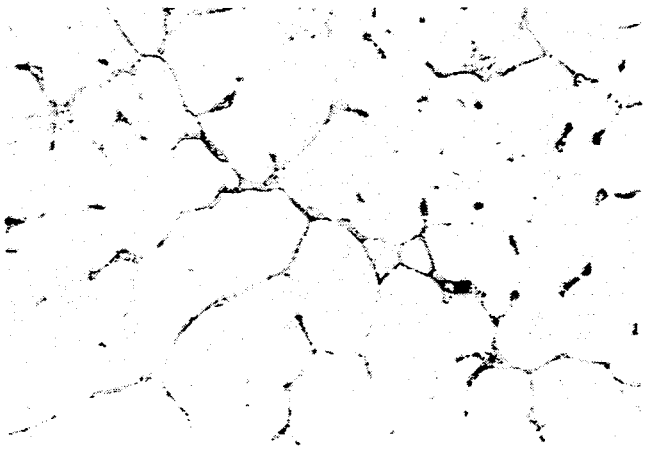
FIG. 3 is a photomicrograph (×100) showing the metal structure of the heat-resistant, ferritic cast steel of Comparative Example 5.

Also, with respect to the heat-resistant cast steel of Comparative Example 5, its photomicrograph (×100) is shown in FIG. 3. White portions in FIG. 3 are usual α-phases called δ-ferrite, and NbC is observed on grain boundaries. The area ratio of α'-phases is 0%.

An exhaust manifold (thickness: 2.5-3.4 mm) and a turbine housing (thickness: 2.7-4.1 mm) as shown in FIG. 1 were produced from the heat-resistant, ferritic cast steel of Example 7. The resulting heat-resistant cast steel parts were free from casting defects. These cast parts were machined to evaluate their cuttability. As a result, no problem was found in any cast parts.

Next, the exhaust manifold and the turbine housing were mounted to a high-performance, straight-type, four-cylinder, 2000-cc gasoline engine (test machine) as shown in FIG. 1 to conduct a durability test. The test was conducted by repeating 500 heating-cooling (Go-Stop) cycles each consisting of a continuous full-load operation at 6000 rpm (14 minutes), idling (1 minute), complete stop (14 minutes) and idling (1 minute) in this order. The exhaust gas temperature under a full load was 930° C. at the inlet of the turbo charger housing. Under this condition, the highest surface temperature of the exhaust manifold was about 870° C. in a pipe-gathering portion thereof, and the highest surface temperature of the turbo charger housing was about 890° C. in a waist gate portion thereof. As a result of the evaluation test, no gas leak and thermal cracking were observed. It was thus confirmed that the exhaust manifold and the turbine housing made of the heat-resistant, ferritic cast steel of the present invention had excellent durability and reliability.

On the other hand, an exhaust manifold was produced from high-Si spheroidal graphite cast iron having a composition shown in Table 5, and a turbo charger housing was produced from austenitic spheroidal graphite cast iron having a composition shown in Table 5 (NI-RESIST D2, trademark of INCO). These parts were mounted to the same engine as above, and the evaluation test was conducted under the same conditions. As a result, the exhaust manifold made of the high-Si spheroidal graphite cast iron underwent thermal cracking due to oxidation in the vicinity of the pipe-gathering portion after 98 cycles, failing to continue the operation. Thereafter, the exhaust manifold was exchanged to that of Example 7 and the evaluation test was continued. As a result, after 324 cycles, cracking took place in a scroll portion of the turbo charger housing made of the austenite spheroidal graphite cast iron. The cracks were penetrating through the scroll portion. It is thus clear that the exhaust manifold and the turbo charger housing according to the present invention have excellent heat resistance.

TABLE 5

| Type | Chemical Component (Weight %) C | Si | Mn | P | S | Cr | Ni | Mo | Mg |
|---|---|---|---|---|---|---|---|---|---|
| High-Si Spheroidal Graphite Cast Iron | 3.15 | 3.95 | 0.47 | 0.024 | 0.008 | 0.03 | — | 0.55 | 0.048 |
| Austenitic Spheroidal Graphite Cast Iron | 2.91 | 2.61 | 0.81 | 0.018 | 0.010 | 2.57 | 21.5 | — | 0.084 |

EXAMPLES 11-19

With respect to each heat-resistant, ferritic cast steel having a composition shown in Table 6, Y-block test pieces (No. B according to JIS) were prepared in the same manner as in Example 1.

TABLE 6

| Example No. | Additive Component (Weight %) C | Si | Mn | Cr | W | Nb | Ni | REM | $\alpha'/(\alpha+\alpha')$ (%) | Transformation Temperature (°C.) |
|---|---|---|---|---|---|---|---|---|---|---|
| 11 | 0.13 | 0.80 | 0.55 | 16.5 | 1.15 | 0.19 | 0.21 | 0.03 | 65 | 920 |
| 12 | 0.15 | 0.93 | 0.48 | 18.6 | 1.95 | 0.33 | 0.74 | 0.04 | 50 | 970 |
| 13 | 0.21 | 1.05 | 0.49 | 20.4 | 2.52 | 0.15 | 0.88 | 0.01 | 40 | 1000 |
| 14 | 0.25 | 1.43 | 0.82 | 21.8 | 2.72 | 0.04 | 1.33 | 0.03 | 35 | 1020 |
| 15 | 0.29 | 0.93 | 0.55 | 24.5 | 2.81 | 0.11 | 1.75 | 0.09 | 30 | 1070 |

TABLE 6-continued

| Example No. | Additive Component (Weight %) C | Si | Mn | Cr | W | Nb | Ni | REM | $\alpha'/(\alpha+\alpha')$ (%) | Transformation Temperature (°C.) |
|---|---|---|---|---|---|---|---|---|---|---|
| 16 | 0.17 | 0.88 | 0.60 | 18.6 | 1.25 | 0.42 | 1.26 | 0.1 | 65 | 920 |
| 17 | 0.19 | 1.08 | 0.44 | 18.3 | 2.45 | 0.28 | 0.66 | 0.1 | 50 | 990 |
| 18 | 0.24 | 0.95 | 0.61 | 18.0 | 2.93 | 0.10 | 0.95 | 0.3 | 75 | 990 |
| 19 | 0.25 | 0.82 | 0.53 | 17.5 | 2.02 | 0.14 | 0.53 | 0.20 | 85 | 930 |

With respect to the heat-resistant, ferritic cast steels of Examples 11-19, their fluidity was good in the process of casting, resulting in no casting defects. Next, test pieces (Y-blocks) of Examples 11-19 were subjected to a heat treatment comprising heating them at 800° C. for 2 hours in a furnace and cooling them in the air.

As shown in Table 6, the test pieces of Examples 11-19 show transformation temperatures of 900° C. or higher.

Next, with respect to each cast test piece, the tensile test at a room temperature, the tensile test at a high temperature, the thermal fatigue test (lowest temperature: 100° C., and highest temperature: 900° C.) and the oxidation test were conducted under the same conditions as in Examples 1-10.

The results of the tensile test at a room temperature are shown in Table 7, and the results of the tensile test at a high temperature, the thermal fatigue test and the oxidation test are shown in Table 8.

TABLE 7

| Example No. | at Room Temperature 0.2% Offset Yield Strength (MPa) | Tensile Strength (MPa) | Elongation (%) | Hardness ($H_B$) |
|---|---|---|---|---|
| 11 | 375 | 490 | 7 | 179 |
| 12 | 455 | 655 | 9 | 223 |
| 13 | 510 | 765 | 13 | 235 |
| 14 | 430 | 640 | 12 | 215 |
| 15 | 490 | 620 | 8 | 207 |
| 16 | 475 | 600 | 8 | 195 |
| 17 | 470 | 540 | 12 | 217 |
| 18 | 520 | 605 | 9 | 192 |
| 19 | 560 | 615 | 7 | 201 |

TABLE 8

| Example No. | at 900° C. 0.2% Offset Yield Strength (MPa) | Tensile Strength (MPa) | Elongation (%) | Thermal Fatigue Life (Cycle) | Weight Loss by Oxidation (mg/cm²) |
|---|---|---|---|---|---|
| 11 | 22 | 38 | 44 | 86 | 2 |
| 12 | 24 | 41 | 54 | 280 | 1 |
| 13 | 23 | 42 | 54 | 495 | 1 |
| 14 | 24 | 45 | 48 | 385 | 2 |
| 15 | 20 | 40 | 56 | 500 | 2 |
| 16 | 24 | 50 | 54 | 365 | 1 |
| 17 | 24 | 48 | 50 | 330 | 1 |
| 18 | 27 | 52 | 41 | 535 | 1 |
| 19 | 29 | 58 | 42 | 485 | 1 |

As is clear from Tables 7 and 8, the test pieces of Examples 11-19 are excellent with respect to a high-temperature strength, an oxidation resistance and a thermal fatigue life. This is due to the fact that by containing proper amounts of W, Nb, Ni and REM, the ferrite matrix was strengthened, and the transformation temperature was elevated to 900° C. or higher without deteriorating the ductility at a room temperature. The comparison of 0.2% offset strength, tensile elongation, thermal fatigue life and oxidation loss shows that although some of Comparative Examples 1-5 are better than those of Examples 11-19 in one of these properties, the cast alloys of the present invention (Examples 11-19) are much better than those of Comparative Examples 1-5 in the total evaluation of these properties.

Also, as shown in Table 7, the test pieces of Examples 11-19 show relatively low hardness ($H_B$) of 179-235. This means that they are excellent in machinability.

Figure 4:
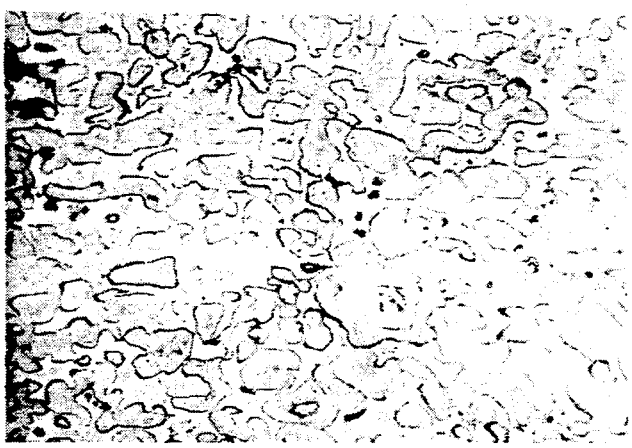
FIG. 4 is a photomicrograph (×100) showing the metal structure of the heat-resistant, ferritic cast steel of Example 18.

Incidentally, with respect to the heat-resistant cast steel of Example 18, its photomicrograph (×100) is shown in FIG. 4. White portions in FIG. 4 are usual α-phases called δ-ferrite, and gray portions encircled by black peripheries are α'-phases transformed from the γ-phases. The area ratio of $\alpha'/(\alpha+\alpha')$ is 75% in Example 18.

EXAMPLES 20-29

With respect to the heat-resistant, ferritic cast steels having compositions shown in Table 9, Y-block test pieces (No. B according to JIS) were prepared in the same manner as in Example 1.

TABLE 9

| Example No. | Additive Component (Weight %) C | Si | Mn | Cr | W | Nb | Ni | REM | V | $\alpha'/(\alpha+\alpha')$ (%) | Transformation Temperature (°C.) |
|---|---|---|---|---|---|---|---|---|---|---|---|
| 20 | 0.12 | 0.88 | 0.48 | 15.6 | 1.48 | 0.02 | 0.07 | 0.12 | 0.20 | 60 | 970 |
| 21 | 0.14 | 1.00 | 0.65 | 18.8 | 2.05 | 0.42 | 0.50 | 0.08 | 0.08 | 30 | 1045 |
| 22 | 0.23 | 1.50 | 0.82 | 21.8 | 1.52 | 0.10 | 1.50 | 0.05 | 0.42 | 28 | 1080 |
| 23 | 0.27 | 1.20 | 0.48 | 23.0 | 2.92 | 0.07 | 0.62 | 0.29 | 0.13 | 28 | 1080 |
| 24 | 0.15 | 0.75 | 0.78 | 18.1 | 2.65 | 0.21 | 0.15 | 0.24 | 0.04 | 35 | 1020 |
| 25 | 0.17 | 0.92 | 0.45 | 20.3 | 1.94 | 0.05 | 1.02 | 0.03 | 0.18 | 25 | 1080 |
| 26 | 0.09 | 1.05 | 0.54 | 18.6 | 2.24 | 0.08 | 1.92 | 0.13 | 0.06 | 40 | 1010 |
| 27 | 0.41 | 1.11 | 0.49 | 18.3 | 2.25 | 0.09 | 0.15 | 0.006 | 0.25 | 35 | 1010 |
| 28 | 0.30 | 0.89 | 0.54 | 17.7 | 1.88 | 0.08 | 0.11 | 0.09 | 0.16 | 50 | 960 |
| 29 | 0.13 | 1.32 | 0.91 | 18.9 | 2.12 | 0.13 | 0.09 | 0.4 | 0.10 | 40 | 1020 |

With respect to the heat-resistant, ferritic cast steels of Examples 20-29, their fluidity was good in the process of casting, resulting in no casting defects. Next, test pieces (Y-blocks) of Examples 20–29 were subjected to a heat treatment comprising heating them at 800° C. for 2 hours in a furnace and cooling them in the air.

As shown in Table 9, the test pieces of Examples 20–29 show transformation temperatures of 950° C. or higher.

Next, with respect to each cast test piece, the same evaluation tests as in Example 1 were conducted under the same conditions as in Example 1. The results of the tensile test at a room temperature are shown in Table 10, and the results of the tensile test at a high temperature, the thermal fatigue test and the oxidation test are shown in Table 11.

TABLE 10

| | at Room Temperature | | | |
|---|---|---|---|---|
| Example No. | 0.2% Offset Yield Strength (MPa) | Tensile Strength (MPa) | Elongation (%) | Hardness ($H_B$) |
| 20 | 415 | 460 | 6 | 212 |
| 21 | 455 | 535 | 9 | 212 |
| 22 | 370 | 400 | 5 | 183 |
| 23 | 425 | 455 | 4 | 217 |
| 24 | 400 | 420 | 5 | 207 |
| 25 | 440 | 450 | 6 | 217 |
| 26 | 380 | 505 | 5 | 187 |
| 27 | 390 | 495 | 6 | 174 |
| 28 | 415 | 475 | 8 | 182 |
| 29 | 400 | 450 | 9 | 179 |

TABLE 11

| | at 900° C. | | | | |
|---|---|---|---|---|---|
| Example No. | 0.2% Offset Yield Strength (MPa) | Tensile Strength (MPa) | Elongation (%) | Thermal Fatigue Life (Cycle) | Weight Loss by Oxidation ($mg/cm^2$) |
| 20 | 22 | 42 | 48 | 215 | 3 |
| 21 | 24 | 46 | 54 | 180 | 2 |
| 22 | 20 | 44 | 45 | 200 | 1 |
| 23 | 25 | 52 | 52 | 240 | 2 |
| 24 | 23 | 48 | 54 | 260 | 2 |
| 25 | 27 | 52 | 60 | 270 | 1 |
| 26 | 22 | 47 | 51 | 200 | 1 |
| 27 | 24 | 45 | 48 | 245 | 1 |
| 28 | 26 | 50 | 57 | 320 | 2 |
| 29 | 25 | 48 | 50 | 255 | 1 |

As is clear from Tables 10–11, the test pieces of Examples 20–29 are excellent with respect to a high-temperature strength, an oxidation resistance and a thermal fatigue life. This is due to the fact that by containing proper amounts of W, Nb, Ni, REM and V, the ferrite matrix was strengthened, and the transformation temperature was elevated to 950° C. or higher without deteriorating the ductility at a room temperature. The comparison of 0.2% offset strength, tensile elongation, thermal fatigue life and oxidation loss shows that although some of Comparative Examples are better than those of Examples 20–29 in one of these properties, the cast alloys of the present invention are much better than those of Comparative Examples in the total evaluation of these properties.

Also, as shown in Table 10, the test pieces of Examples 20–29 show relatively low hardness ($H_B$) of 174–217. This means that they are excellent in machinability.

Figure 5:
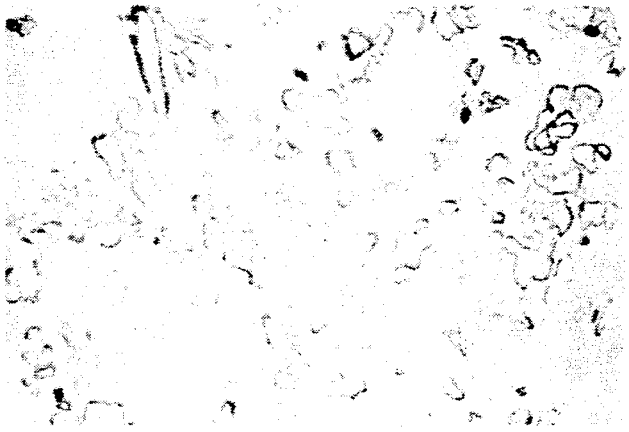
FIG. 5 is a photomicrograph (×100) showing the metal structure of the heat-resistant, ferritic cast steel of Example 28.

Incidentally, with respect to the heat-resistant cast steel of Example 28, its photomicrograph (×100) is shown in FIG. 5. White portions in FIG. 5 are usual α-phases called δ-ferrite, and gray portions encircled by black peripheries are α'-phases transformed from the γ-phases. The area ratio of $\alpha'/(\alpha+\alpha')$ is 50% in Example 28.

An exhaust manifold (thickness: 2.5–3.4 mm) and a turbine housing (thickness: 2.7–4.1 mm) were produced from the heat-resistant, ferritic cast steel of Examples 15 and 25. All of the resulting heat-resistant cast steel parts were free from casting defects. These cast parts were machined to evaluate their cuttability. As a result, no problem was found in any cast parts.

Next, the exhaust manifold and the turbine housing were mounted to a high-performance, straight-type, four-cylinder, 2000-cc gasoline engine (test machine) as shown in FIG. 1 to conduct a durability test. The test conditions were the same as in Example 7. As a result of the evaluation test, no gas leak and thermal cracking were observed. It was thus confirmed that the exhaust manifold and the turbine housing made of the heat-resistant, ferritic cast steel of the present invention had excellent durability and reliability.

As described above in detail, by adding W, Nb and/or V, REM, and if necessary, Ni in proper amounts to cast steel according to the present invention, the ferrite matrix and the crystal grain boundaries are strengthened, whereby the transformation temperature of the heat-resistant, ferritic cast steel is elevated without deteriorating the ductility at a room temperature. As a result, the heat-resistant, ferritic cast steel of the present invention has an improved high-temperature strength. Thus, with respect to particularly important high-temperature strength, thermal fatigue resistance and oxidation resistance, the heat-resistant, ferritic cast steel of the present invention is superior to the conventional heat-resistant cast steel. In addition, since the heat-resistant, ferritic cast steel of the present invention is excellent in castability and machinability, it can be formed into cast articles at a low cost. Such heat-resistant, ferritic cast steel according to the present invention is particularly suitable for exhaust equipment members for engines, etc. The exhaust equipment members made of such heat-resistant, ferritic cast steel according to the present invention show extremely good durability without suffering from thermal cracking.

What is claimed is:

1. A heat-resistant, ferritic cast steel having a composition consisting essentially, by weight, of:

C: 0.15–0.45%,
Si: 2.0% or less,
Mn: 1.0% or less,
Cr: 17.0–22.0%,
W: 1.0–3.0%,
Nb and/or V: 0.01–0.45%,
REM: 0.01–0.5%, and
Fe and inevitable impurities: balance, wherein REM represents at least one rare earth metal, said cast steel having, in addition to a usual α-phase, a pearlitic α'-phase transformed from a γ-phase, said α'-phase consisting of the α-phase and carbides, and an area ratio ($\alpha'/(\alpha+\alpha')$) being 20–80%.

2. The heat-resistant, ferritic cast steel according to claim 1, wherein a transformation temperature from the α'-phase to the γ-phase is 1000° C. or higher.

3. The heat-resistant, ferritic cast steel according to claim 1, wherein said cast steel is subjected to an annealing treatment at a temperature at which the α'-phase is not transformed to the γ-phase.

4. An exhaust equipment member made of a heat-resistant, ferritic cast steel according to claim 1.

5. The exhaust equipment member according to claim 4, wherein said exhaust equipment member is an exhaust manifold.

6. The exhaust equipment member according to claim 4, wherein said, exhaust equipment member is a turbine housing.

7. A heat-resistant, ferritic cast steel having a composition consisting essentially, by weight, of:

C: 0.05–0.30%,
Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%, and
Fe and inevitable impurities: balance, wherein REM represents at least one rare earth metal, said cast steel having, in addition to a usual $\alpha$-phase, a pearlitic $\alpha'$-phase transformed from a $\gamma$-phase, said $\alpha'$-phase consisting of the $\alpha$-phase and carbides, and an area ratio $(\alpha'/(\alpha+\alpha'))$ being 20–90%.

8. The heat-resistant, ferritic cast steel according to claim 7, wherein a transformation temperature from the $\alpha'$-phase to the $\gamma$-phase is 900° C. or higher.

9. The heat-resistant, ferritic cast steel according to claim 7, wherein said cast steel is subjected to an annealing treatment at a temperature at which the $\alpha'$-phase is not transformed to the $\gamma$-phase.

10. An exhaust equipment member made of a heat-resistant, ferritic cast steel according to claim 7.

11. The exhaust equipment member according to claim 10, wherein said exhaust equipment member is an exhaust manifold.

12. The exhaust equipment member according to claim 10, wherein said exhaust equipment member is a turbine housing.

13. A heat-resistant, ferritic cast steel having a composition consisting essentially, by weight, of:

C: 0.05–0.30%,
Si: 2.0% or less,
Mn: 1.0% or less,
Cr: 16.0–25.0%,
W: 1.0–3.0%,
Nb: 0.01–0.45%,
Ni: 0.1–2.0%,
REM: 0.01–0.5%,
V: 0.01–0.3%, and
Fe and inevitable impurities: balance, wherein REM represents at least one rare earth metal, said cast steel having, in addition to a usual $\alpha$-phase, a pearlitic $\alpha'$-phase transformed from a $\gamma$-phase, said $\alpha'$-phase consisting of the $\alpha$-phase and carbides, and an area ratio $(\alpha'/(\alpha+\alpha'))$ being 20–70%.

14. The heat-resistant, ferritic cast steel according to claim 13, wherein a transformation temperature from the $\alpha'$-phase to the $\gamma$-phase is 950° C. or higher.

15. The heat-resistant, ferritic cast steel according to claim 13, wherein said cast steel is subjected to an annealing treatment at a temperature at which the $\alpha'$-phase is not transformed to the $\gamma$-phase.

16. An exhaust equipment member made of a heat-resistant, ferritic cast steel according to claim 13.

17. The exhaust equipment member according to claim 16, wherein said exhaust equipment member is an exhaust manifold.

18. The exhaust equipment member according to claim 16, wherein said exhaust equipment member is a turbine housing.

* * * * *